US009210951B2

(12) United States Patent
Borst et al.

(10) Patent No.: US 9,210,951 B2
(45) Date of Patent: Dec. 15, 2015

(54) TOBACCO CUT FILLER INCLUDING CUT ROLLED STEMS

(75) Inventors: Roelof Cornelis De Borst, Yverdon-les-Bains (CH); Poh Yoke Tritz, Yverdon-les-Bains (CH); Harald Hoffmann, Stettlen (CH); Charles Kuersteiner, Jouxtens-Mezery (CH)

(73) Assignee: Philip Morris Products S.A., Neuchatel (CH)

( * ) Notice: Subject to any disclaimer, the term of this patent is extended or adjusted under 35 U.S.C. 154(b) by 91 days.

(21) Appl. No.: 13/995,605

(22) PCT Filed: Dec. 22, 2011 (Under 37 CFR 1.47)

(86) PCT No.: PCT/EP2011/073789
§ 371 (c)(1), (2), (4) Date: Jan. 9, 2014

(87) PCT Pub. No.: WO2012/085201
PCT Pub. Date: Jun. 28, 2012

(65) Prior Publication Data

US 2014/0137882 A1 May 22, 2014

(30) Foreign Application Priority Data

Dec. 23, 2010 (EP) ..... 10252214

(51) Int. Cl.
*A24B 13/00* (2006.01)
*A24B 5/16* (2006.01)

(52) U.S. Cl.
CPC .. *A24B 13/00* (2013.01); *A24B 5/16* (2013.01)

(58) Field of Classification Search
USPC ..... 131/290, 347, 352
See application file for complete search history.

(56) References Cited

U.S. PATENT DOCUMENTS

| | | | | |
|---|---|---|---|---|
| 3,219,042 | A | 11/1965 | Molins | |
| 3,411,514 | A | 11/1968 | Hind | |
| 3,690,328 | A | 9/1972 | Quarenghi | |
| 3,734,104 | A * | 5/1973 | Buchanan et al. | 131/296 |
| 4,211,243 | A | 7/1980 | Ohno | |
| 4,300,579 | A | 11/1981 | Ulrich | |
| 4,418,706 | A | 12/1983 | Kim | |
| 4,646,764 | A | 3/1987 | Young | |
| 4,787,402 | A | 11/1988 | Leonard | |
| 5,722,431 | A | 3/1998 | Metzner | |
| 5,826,590 | A | 10/1998 | Metzner | |
| 6,568,401 | B1 | 5/2003 | Salmon | |
| 7,503,330 | B2 * | 3/2009 | Borschke et al. | 131/360 |
| 2004/0255965 | A1 * | 12/2004 | Perfetti et al. | 131/353 |

FOREIGN PATENT DOCUMENTS

| | | | |
|---|---|---|---|
| BR | PI9204177 | A | 5/1993 |
| BR | PI0518864 | A | 12/2008 |
| BR | PI0607252 | A | 3/2010 |
| BR | PI0203940 | A | 1/2012 |
| BR | PI0400277 | A | 11/2012 |
| CA | 971068 | A1 | 7/1975 |
| CN | 86107969 | | 7/1987 |
| CN | 1806704 | | 7/2006 |
| CN | 1963386 | | 5/2007 |
| CN | 101371719 | | 2/2009 |
| CN | 101444328 | | 6/2009 |
| DE | 14 32 585 | A1 | 11/1968 |
| EA | 000059 | B1 | 4/1998 |
| EA | 000060 | B1 | 4/1998 |
| EA | 003544 | B1 | 6/2003 |
| EA | 004483 | B1 | 4/2004 |
| EA | 004888 | B1 | 8/2004 |
| EA | 005085 | B1 | 10/2004 |
| EP | 0539064 | A1 | 4/1993 |
| EP | 0 539 064 | | 3/1995 |
| EP | 0773212 | A1 | 5/1997 |
| EP | 0774213 | A1 | 5/1997 |
| EP | 0845218 | B1 | 6/1998 |
| EP | 1056362 | A1 | 7/1999 |
| EP | 1444905 | B1 | 8/2004 |
| EP | 2124655 | A1 | 8/2008 |
| GB | 1089361 | A | 1/1965 |
| JP | 4058040 | B2 | 12/2007 |
| JP | 4388960 | B2 | 10/2009 |
| JP | 2009254387 | A | 11/2009 |
| PH | 1/0/31987 | A | 6/1999 |
| PH | 1/2004/502021 | A | 3/2008 |
| PH | 1/2007/501291 | A | 4/2011 |
| PH | 1/2007/500186 | A | 2/2012 |
| RU | 2267971 | A | 1/2006 |
| RU | 2350233 | A | 3/2009 |
| RU | 2401621 | A | 10/2010 |

(Continued)

OTHER PUBLICATIONS

PCT International Search Report and Written Opinion dated Mar. 5, 2012 for PCT/EP2011/073789.

Philippine Examination Report for Application No. 1/2013/501238 dated Dec. 3, 2014, 3 pages.

Office Action issued in Kazakhstan for Application No. 2013/1604.1, dated Aug. 26, 2014, 8 pages. English translation included.

Chinese Office Action for Application No. 201180066542.3 dated Mar. 23, 2015 (17 pages). English translation included.

*Primary Examiner* — Dennis Cordray

(74) *Attorney, Agent, or Firm* — Mueting, Raasch & Gebhbardt, P.A.

(57) ABSTRACT

A tobacco cut filler for a smoking article comprises at least 5% by weight of cut rolled tobacco stems having a mean cut width of 0.1 mm to 0.2 mm and a mean cross-sectional area of between 0.12 and 0.15 square millimeters. The mean thickness of the cut rolled stems is preferably between 0.8 mm and 1.0 mm.

18 Claims, No Drawings

(56) References Cited

FOREIGN PATENT DOCUMENTS

| | | |
|---|---|---|
| WO | WO 91/12736 | 9/1991 |
| WO | 2006/103404 A1 | 10/2006 |
| WO | WO 2009/076699 | 6/2009 |

* cited by examiner

TOBACCO CUT FILLER INCLUDING CUT ROLLED STEMS

This application is a U.S. National Stage Application of International Application No. PCT/EP2011/073789, filed Dec. 22, 2011, which was published in English on Jun. 28, 2012 as International Patent Publication WO 2012/085201 A1. International Application No. PCT/EP2011/073789 also claims priority to European Application No. 10252214.1, filed Dec. 23, 2010.

The present invention relates to a novel tobacco cut filler comprising cut rolled stems and to a smoking article formed from a tobacco rod of the cut filler according to the invention.

Conventionally, cut filler tobacco products for smoking articles are formed predominantly from the lamina portion of the tobacco leaf, which is separated from the stem portion of the leaf during a threshing process. Much of the stem portion that remains after the lamina has been removed and separated is not used. In order to increase the amount of the tobacco material that can be used commercially, it has been previously proposed to add some tobacco stems back into the cut filler together with the lamina. In order to improve the taste and burning characteristics of the tobacco stem for use in the cut filler, the stems are often first subjected to one or more treatment procedures, such as expansion.

For example, in a known process for the treatment of tobacco stems, the stems are first rolled to a thickness of 1 mm before being expanded such that the thickness is increased significantly above 1 mm. After expansion, the tobacco stems are incorporated into a tobacco cut filler.

It would be desirable to provide a tobacco cut filler comprising a proportion of tobacco stems which have been processed in an alternative way in order to more effectively improve the taste and burning characteristics of the tobacco stems. It would be particularly desirable if the inclusion of the tobacco stems could have a positive effect on the cut filler, for example by increasing the filling power of the tobacco cut filler and improving coal drop-off, while minimising the effect on taste.

According to the invention there is provided a tobacco cut filler comprising at least 5% by weight of cut rolled tobacco stems having a mean cut width of about 0.1 mm to about 0.2 mm and a mean cross-sectional area of 0.12 to 0.15 square millimeters ($mm^2$). Particularly preferably, the mean cross-sectional area of the cut rolled tobacco stems is around 0.135 square millimeters ($mm^2$).

Preferably, the rolled thickness of the cut rolled tobacco stems in the cut filler is about 0.8 mm to about 1.0 mm. Particularly preferably, the rolled thickness of the cut rolled tobacco stems in the cut filler is around 0.9 mm.

The 'rolled thickness' of the cut rolled stems of cut fillers according to the invention refers to the distance between an upper surface that has been contacted with a rolling apparatus (as described in more detail below) and a lower surface that has been contacted with a rolling apparatus. The rolled thickness therefore corresponds to the dimension of the cut rolled tobacco stems that is reduced in size during the rolling process, which is typically substantially transverse to the direction of movement of the tobacco stems through the rolling apparatus. The rolled thickness of an individual tobacco stem particle can be measured using a conventional measuring device under a microscope. The rolled thickness of an individual stem particle is taken at the point along the direction of cutting that yields the largest cross-sectional area.

For the purposes of the present invention, the rolled thickness of the cut rolled tobacco stems refers to the stable rolled thickness of the tobacco stems after all of the treatment steps have been carried out. The rolled thickness therefore corresponds to the rolled thickness immediately before the cut filler is incorporated into a smoking article, or when the cut filler is in place within a smoking article. At this stage, the thickness of the stems does not change more than 5% over a period of one week when the cut rolled stems are held at a constant temperature and a constant pressure of 1 atmosphere.

The 'cut width' of the cut rolled stems in cut fillers according to the invention refers to the width of the stem in the direction along which the tobacco stem has been cut. When looking at a stem particle under a microscope, it will generally be possible to observe the direction along which the stem particle has been run through the cutting apparatus. The cut width corresponds to the distance between the two sides of a particle of tobacco stem along this direction of cutting. The cut width of an individual tobacco stem particle can be accurately measured using a conventional measuring device under a microscope. The cut width of an individual stem particle is taken at the point along the direction of cutting that yields the largest cross-sectional area.

The 'cross-sectional area' of the cut rolled stems in cut fillers according to the invention refers to the transverse cross-sectional area, which is the cross-sectional area of the cut rolled stem material, transverse to the direction of cutting. The transverse cross-sectional area of a particle of stem material is taken at the point along the direction of cutting on the stem particle that yields the largest transverse cross-sectional area. The transverse cross-sectional area will be the same as, or can be approximated as, the rolled thickness multiplied by the cut width. Unless otherwise indicated, any references in the present specification to the 'cross-sectional area' of the stem particles refer to the transverse cross-sectional area.

In order to measure the rolled thickness and cut width of the cut rolled stems of cut fillers according to the invention, the tobacco stems must first be separated from the tobacco lamina and other tobacco materials in the cut filler. This can be achieved by visually assessing the cut filler and qualitatively determining which particles of the cut filler are stems and which are lamina or other material. The mean values of cut width and cross-sectional area are determined for the cut rolled stems within the sample of cut filler.

According to the invention there is also provided a smoking article comprising a rod of the tobacco cut filler according to the invention. Preferably, smoking articles according to the invention further comprise a filter in axial alignment with the tobacco rod and connected to the tobacco rod by means of tipping paper. Tobacco cut fillers according to the invention are suitable for use in conjunction with a wide variety of filters, which would be known to the skilled person.

It has surprisingly been found that the use of tobacco stem particles having a controlled size and cross-sectional area improves the combustion characteristics of cut filler incorporating the stem particles. It has also surprisingly been found that when using the cut rolled tobacco stems, the impact of the stems on the taste characteristics of the mainstream smoke from the cut filler is limited or in some cases, favourable. The use of cut rolled tobacco stem particles having dimensions within the ranges indicated above also provides improved filling power and an acceptable level of both dust and heavy particles, as discussed further below.

As a result of these positive effects on the properties of the tobacco stems, a significantly greater proportion of tobacco stem particles can be incorporated into the cut filler than has previously been possible. The use of cut rolled stems having the dimensions indicated above in place of the tobacco lamina in cut filler is cost effective, since the stems are typically available at a lower cost than the tobacco lamina. The use of the cut rolled tobacco stems also has a positive environmental impact, since a greater proportion of the tobacco material, including the stem portion, can be used as a component of tobacco cut filler according to the present invention.

Tobacco cut fillers according to the invention comprise at least 5% by weight of the cut rolled tobacco stems, preferably at least 10% by weight, and more preferably at least 20% by weight. Tobacco cut fillers according to the invention may comprise up to 100% by weight of the cut rolled tobacco stems, preferably up to 40% by weight, more preferably up to 35% by weight. For example, certain cut fillers according to the invention may contain between 5% and 95% by weight of the cut rolled tobacco stems of the invention, preferably between 5% and 40% by weight, or more preferably between 10% and 35%.

Tobacco cut fillers according to the invention may comprise cut rolled tobacco stems from one or more types of tobacco plant, including but not limited to the stems from Burley tobacco, Oriental tobacco, Virginia tobacco or combinations thereof. The remainder of the cut filler may be made up from tobacco lamina, reconstituted tobacco, expanded tobacco, or any combinations thereof.

Preferably, the tobacco cut filler comprises at least 60%, and preferably at least 80% by weight tobacco lamina having a mean cut width between 0.8 mm and 1.1 mm, more preferably about 0.9 mm, and a mean thickness of about 0.2 mm. The tobacco cut filler comprises up to 95% by weight tobacco lamina with a mean cut width between 0.8 mm and 1.1 mm, more preferably about 0.9 mm, and a mean thickness of about 0.2 mm. The particles of tobacco lamina in the cut filler are therefore of similar dimensions to the particles of tobacco stem. As such, the tobacco stems are not visually distinct from the tobacco lamina, even at a high inclusion rate. In addition, the blend of tobacco stems and lamina can advantageously be transported and processed effectively without significant settling of the stems. Preferably, the mean cut width of the cut rolled tobacco stems is within about 0.1 mm, more preferably within about 0.05 mm of the mean thickness of the tobacco lamina in the cut filler.

Preferably, the rolling process of the tobacco stems for use in tobacco cut fillers according to the invention ensures that the cellular structure of the stems, in particular the epidermis of the stems, remains substantially intact. This may be achieved by rolling the stems in the stemmery to a final thickness of about 0.7 mm. Alternatively, this could be achieved by rolling the stems at the cigarette factory to a final thickness of about 0.9 mm. The rolling can be performed when the stems are at a relatively high moisture level (as discussed below) to conserve as much of the cellular structure as possible, in particular the epidermis of the cells of the tobacco stems. The preservation of the cellular structure may facilitate subsequent steps in the process, such as expansion of the cut rolled stems. The intact cellular structure of the tobacco stems is observable, for example when the stems are viewed under a microscope.

A further advantage of tobacco cut fillers according to the invention is the increase in the filling power of the cut filler comprising cut rolled tobacco stems having a mean cut width of 0.1 mm to 0.2 mm and a mean cross-sectional area of between 0.12 and 0.15 square millimeters ($mm^2$), compared to the filling power of cut filler comprising particles of conventionally processed tobacco stem. Preferably, the cut rolled stems used in cut fillers according to the invention have a filling power of at least 6.3 cubic centimeters per gram ($cm^3/g$) at a reference moisture level of 12.5% oven volatiles. More preferably, the cut rolled stems used in cut fillers according to the invention have a filling power of at least 6.5 cubic centimeters per gram ($cm^3/g$) at a reference moisture level of 12.5% oven volatiles.

The filling power of the tobacco stems depends upon the physical properties, cell structure and epidermis of the stem and may therefore differ according to the origin, stalk position and weather conditions during growth of the tobacco plant. However, the cut rolled tobacco stems used in cut fillers according to the invention will typically have a filling power that is increased by about 0.3 cubic centimeters per gram, or by about 0.5 cubic centimeters per gram ($cm^3/g$), compared to conventionally processed stems.

The 'filling power' of a tobacco material describes the volume of space taken up by a given weight or mass of the material. The greater the filling power of a tobacco material, the lower the weight of the material required to fill a tobacco rod of standard dimensions. The values of filling power are expressed in terms of corrected cylinder volume (CCV) which is the cylinder volume (CV) of the tobacco material at a reference moisture level of 12.5% oven volatiles. The cylinder volume (CV) may be determined using a Borgwaldt densimeter DD60 or DD60A type fitted with a measuring head for cut tobacco and a tobacco cylinder container.

In a suitable method for determining the value of CCV, a sample of the cut filler is placed in the tobacco cylinder container of the Borgwaldt densimeter and subjected to a load of 2 kg for 30 seconds. The height of the sample after the loading time has expired is measured and this is converted to a cylinder volume using the formula:

$$CV = \frac{r^2 \cdot h \cdot \pi}{SW \cdot 10}$$

where r is the cylinder radius (3.00 cm for the densimeter indicated above), h is the height of the sample after the loading time has expired and SW is the weight of the sample. The measured CV is then converted to a corrected value of CCV at the reference moisture level value (ROV) of 12.5% oven volatiles, using the formula:

$$CCV=(OV-ROV)\cdot f+CV$$

where OV is the actual % oven volatiles of the sample of tobacco stems and f is a correction factor (0.4 for the test indicated).

The moisture content of the tobacco stems is expressed herein as "% oven volatiles", which is determined by measuring the percentage weight loss from the stems upon drying the material in an oven at 103 degrees Centigrade (° C.) for 100 minutes. It is assumed that a significant majority of the weight loss from the stems results from the evaporation of moisture.

It is desirable if both the dust level and the level of heavy particles in tobacco cut filler are minimised. Preferably, the cut rolled stems of the cut filers according to the invention therefore comprise less than 7.5% by weight of dust particles having a particle size of less than 500 micrometers, more preferably less than 10% by weight. The proportion of large and heavy particles in the cut rolled stems is advantageously minimised to improve the combustion characteristics of the cut filler. Preferably, the cut rolled stems of the cut fillers according to the invention comprise less than 0.4% by weight of particles having a particle size greater than 3.35 mm, more preferably less than 0.3% by weight.

The proportion of the cut rolled stems within these limits can be determined using a known sieve test with screens having sieve openings of 500 micrometers (mesh size 32) and 3.35 mm (mesh size 6). It has been found that both the dust levels and the proportion of large, heavy particles in cut rolled stems according to the invention is relatively low compared to cut rolled stems having larger or smaller particles of tobacco stem.

As illustrated in the comparative example below, in some cases in which the tobacco stems are rolled to a larger thickness and therefore have a greater cross-sectional area than those used in this invention, the stems have a significantly increased percentage of heavy particles. In addition, in other cases in which the stems are rolled to a lesser thickness and therefore have a lower cross-sectional area than used in this invention, the stems have a significantly increased percentage of dust. In contrast, where the stems are processed to have a cut width between 0.1 mm and 0.2 mm and a cross-sectional area of between 0.12 and 0.15 square millimeters ($mm^2$), as in the present invention, the cut filler has a limited level of both dust and heavy particles. Particularly, the proportion of heavy particles in the cut rolled stems used in the present invention is decreased by at least 0.2% by weight compared to conventionally processed stems.

Tobacco cut fillers according to the present invention can be produced using a method comprising the steps of: rolling tobacco stems; cutting the rolled tobacco stems to a mean cut width of 0.1 mm to 0.2 mm; and combining the cut rolled tobacco stems with cut tobacco lamina material to provide a cut filler having at least 5% by weight of the rolled tobacco stems.

The rolling step is preferably carried out on the green tobacco stems in the stemmery, after the stems have been separated from the tobacco lamina in a suitable threshing process. In this case, the green tobacco stems typically have a high moisture content and are therefore soft and pliable, which in some cases can help minimise damage to the green tobacco stems during rolling. In the stemmery, the stems are preferably rolled to a mean thickness of 0.6 mm to 0.8 mm. During subsequent processing and storage steps, the stems will expand to their final desired thickness of 0.8 mm to 1.0 mm. After rolling, the stems are dried and transferred to the tobacco production plant, where they are cut and added to the tobacco cut filler.

In some cases, the rolling step may alternatively be incorporated as part of the on-line production process for cut filler. In this case, after threshing, the stems will be dried in the stemmery to a moisture content of around 10% to 11% oven volatiles and transferred to the tobacco production plant, where the rolling step will be carried out upstream of the apparatus for producing the cut filler. Where the stems are rolled as part of the on-line production process, the stems are preferably rolled to a mean thickness of 0.8 mm to 1.0 mm.

Preferably, in either case, the moisture content of the tobacco stems is around 28% to 34% oven volatiles prior to rolling in order to prevent damage to the structure of the stems. If necessary, the tobacco stems are conditioned prior to rolling in order to increase the moisture content to this level. Known processes for conditioning tobacco stems involve contacting the stems with water, steam or a mixture of water and steam. In methods where the rolling step is incorporated on-line and dried stems are received from the stemmery, the conditioning step will typically take longer and may require a soaking step in which the stems are soaked in water for a number of hours prior to rolling. Such a soaking step is typically not required when the green tobacco stems are rolled in the stemmery.

The tobacco stems may be rolled using a one step rolling process to reduce the thickness of the stems to the desired mean thickness. After rolling, the stems are cut to a cut width of between 0.1 mm and 0.2 mm. The cut rolled stems are then optionally expanded using known stem expansion techniques, and then dried. Where the stems are pre-rolled and dried at the stemmery, it will typically be necessary to condition the stems prior to cutting in order to increase the moisture content of the tobacco stems back to between 28% and 34% oven volatiles. This increases the pliability of the tobacco stems in order to limit damage or breakage of the stems during cutting.

Finally, the cut rolled stems are combined with tobacco cut lamina and any additional tobacco materials in order to form cut filler having at least 5% by weight of the cut rolled tobacco stems.

Cut fillers according to the invention may be incorporated into a variety of smoking articles. For example, the cut filler may be used in the tobacco rod of a combustible smoking article, such as a filter cigarette, cigarillo or cigar. Alternatively, the cut filler may be used to provide the tobacco aerosol generating substrate in a distillation based smoking article, or an electrically heated smoking system. Alternatively, the cut filler may be used as a roll-your-own product, or loose tobacco product for example, for use in a pipe.

Smoking articles comprising cut filler according to the invention may be packaged in containers, for example, containers formed of one or more folded laminar blanks. Suitable containers include but are not limited to hinge lid containers and slide and shell containers.

The invention will be further described by way of the following comparative example:

COMPARATIVE EXAMPLE

In a process for producing cut filler according to the present invention, the stems were first separated from the remainder of the tobacco leaf using a suitable threshing process. At this stage, the green tobacco stems had a moisture content of around 17% to 20% oven volatiles. Still within the stemmery, the stems were conditioned by contacting them with a stream of steam and water until the moisture content of the stems reached about 32% o.v. The moistened stems were then flattened between rollers to a rolled thickness of 0.7 mm.

The rolled stems were dried, packaged and transferred from the stemmery to the tobacco production plant. At the tobacco production plant, the pre-rolled stems were first conditioned in a suitable conditioning device by contacting the stems with a stream of steam and water until the moisture content of the stems returned to about 34% o.v. During this conditioning step, the rolled stems expanded to a mean thickness of about 0.9 mm.

The moistened rolled stems were cut to an average cut width of 0.15 mm to achieve a cross-sectional area of 0.135 square millimeters ($mm^2$). The cut rolled stems were then expanded and dried before being combined with cut tobacco lamina to form the cut filler. The cut rolled stems and tobacco lamina were blended to form a cut filler having 6% by weight of the cut rolled stems.

The proportion of dust particles and large, heavy particles in the cut rolled tobacco stems produced in the process described above was determined in a suitable sieve test using screens having openings 500 micrometers and 3.35 mm, respectively. The filling power of the rolled tobacco stems (CCV) was also determined using the method described above. The results are shown in the table below.

Three comparative samples of cut rolled tobacco stems were produced using a similar process to that described above but where the tobacco stems were rolled to 0.9 mm, 0.5 mm or 0.3 mm, respectively. Comparative sample 1 corresponded to a sample of conventionally treated tobacco stems.

The cut width of the tobacco stems remained constant at 0.15 mm and therefore the cross-sectional area of the tobacco stems was in direct proportion to the mean thickness of the stems. The tobacco stems having a mean thickness of 0.9 mm had a greater cross-sectional area than the stems for use in cut fillers according to the present invention, whilst the tobacco stems having a mean thickness of 0.5 mm or 0.3 mm had a smaller cross-sectional area. For each comparative sample, the particle size distribution and the filling power was determined in the same way as for the sample according to the present invention. The results for each sample are shown in the table below. In each case, the values provided correspond to the mean value from 5 substantially identical samples.

| | Sample according to the invention | Comparative sample 1 | Comparative sample 2 | Comparative sample 3 |
|---|---|---|---|---|
| Mean thickness after rolling (mm) | 0.7 | 0.9 | 0.5 | 0.3 |
| Mean rolled thickness in cut filler (mm) | 0.9 | 1.1 | 0.7 | 0.5 |
| Stem cut width (mm) | 0.15 | 0.15 | 0.15 | 0.15 |
| Mean cross-sectional area ($mm^2$) | 0.135 | 0.165 | 0.105 | 0.750 |
| Mean CCV ($cm^3/g$) | 6.5 | 6.1 | 6.2 | 6.5 |
| % by weight of dust particles (<500 micrometers) | 6.5 | 6.7 | 11.5 | 12.9 |
| % by weight of large particles (>3.35 mm) | 0.2 | 0.5 | 0.1 | 0.1 |

It can be seen from the table above that the filling power of the cut rolled tobacco stems is optimised at the 0.7 mm and 0.3 mm rolled thicknesses. However, comparative samples 2 and 3, the cut rolled stems have a significantly higher level of dust particles than in the 0.7 mm sample for use in cut fillers according to the invention.

Whilst the comparative sample 1 was found to have lower dust levels, the level of large and heavy particles was more than double that of the 0.7 mm sample for use in cut fillers according to the invention.

The measured values in the table above therefore illustrate that the 0.7 mm cut rolled stems (corresponding to stems having a final thickness of 0.9 mm) provide a balanced combination of improved filling power and reduced levels of dust particles and large particles.

The invention claimed is:

1. A tobacco cut filler for a smoking article comprising between 10% and 40% by weight of cut rolled tobacco stems having been rolled to a mean thickness of 0.6 mm to 0.8 mm and having a mean cut width of 0.1 mm to 0.2 mm and a mean cross-sectional area of 0.12 to 0.15 square millimeters.

2. A tobacco cut filler according to claim 1 comprising at least 20% by weight of cut rolled stems.

3. A tobacco cut filler according to claim 1 wherein the cut rolled tobacco stems expand to a final mean thickness of 0.9 mm.

4. A tobacco cut filler according to claim 1 wherein the cut rolled tobacco stems have a filling power of at least 6.3 cubic centimeters per gram at a reference moisture value of 12.5% oven volatiles.

5. A tobacco cut filler according to claim 1 wherein the cut rolled tobacco stems have less than 7.5% by weight of particles having a particle size of less than 500 micrometers.

6. A tobacco cut filler according to claim 1 wherein the cut rolled tobacco stems have less than 0.3% by weight of particles having a particle size greater than 3.35 mm.

7. A tobacco cut filler according to claim 1 wherein the cut rolled tobacco stems have a substantially intact epidermal cellular structure.

8. A tobacco cut filler according to claim 1 comprising at least 60% by weight tobacco lamina having a mean cut width of 0.8 mm to 1.1 mm and a mean thickness of about 0.2 mm.

9. A tobacco cut filler according to claim 8 wherein the mean cut width of the cut rolled tobacco stems is within 0.05 mm of the mean thickness of the tobacco lamina.

10. A tobacco cut filler according to claim 1 wherein the cut rolled tobacco stems have a mean thickness of 0.8 mm to 1.0 mm and wherein the cut rolled tobacco stems have a filling power of at least 6.3 cubic centimeters per gram at a reference moisture value of 12.5% oven volatiles.

11. A tobacco cut filler according to claim 1 wherein the cut rolled tobacco stems have a mean thickness of 0.8 mm to 1.0 mm and the cut rolled tobacco stems have a substantially intact epidermal cellular structure.

12. A tobacco cut filler according to claim 1 wherein the cut rolled tobacco stems have a filling power of at least 6.3 cubic centimeters per gram at a reference moisture value of 12.5% oven volatiles and wherein the cut rolled tobacco stems have a substantially intact epidermal cellular structure.

13. A tobacco cut filler according to claim 1 wherein the cut rolled tobacco stems have less than 7.5% by weight of particles having a particle size of less than 500 micrometers and wherein the cut rolled tobacco stems have a substantially intact epidermal cellular structure.

14. A smoking article comprising a rod of the tobacco cut filler according to claim 1.

15. A tobacco cut filler for a smoking article comprising at least 10% by weight of cut rolled tobacco stems having a mean cut width of 0.1 mm to 0.2 mm and a mean cross-sectional area of 0.12 to 0.15 square millimeters, wherein the cut rolled tobacco stems have a substantially intact epidermal cellular structure.

16. A tobacco cut filler according to claim 15, wherein the cut rolled tobacco stems have a mean thickness of 0.8 mm to 1.0 mm.

17. A tobacco cut filler according to claim 15, wherein the cut rolled tobacco stems have a filling power of at least 6.3 cubic centimeters per gram at a reference moisture value of 12.5% oven volatiles.

18. A tobacco cut filler according to claim 15, wherein the cut rolled stems have less than 7.5% by weight of particles having a particle size of less than 500 micrometers.

* * * * *